US007347020B2

(12) United States Patent
Ray et al.

(10) Patent No.: US 7,347,020 B2
(45) Date of Patent: Mar. 25, 2008

(54) MESSAGE BOARD APPARATUS

(76) Inventors: Prasenjit Ray, 308 Second St., St. Augustine, FL (US) 32084; Jason L. Swartley, 2413 Lobach Dr., Mechanicsburg, PA (US) 17055; George P. Angell, 1018 SE. 140th Ct., Vancouver, WA (US) 98683; Todd E. Foreman, 5230 Carversville Rd., Doylestown, PA (US) 18901; Cutis W. Krazer, 1192 Sycamore Ave., Easton, PA (US) 18040

( * ) Notice: Subject to any disclaimer, the term of this patent is extended or adjusted under 35 U.S.C. 154(b) by 329 days.

(21) Appl. No.: 11/177,272

(22) Filed: Jul. 8, 2005

(65) Prior Publication Data

US 2007/0006505 A1 Jan. 11, 2007

(51) Int. Cl.
*A47G 1/06* (2006.01)

(52) U.S. Cl. ..... 40/781; 40/711; 40/725

(58) Field of Classification Search ..... 40/781, 40/722–726, 600, 711, 790
See application file for complete search history.

(56) References Cited

U.S. PATENT DOCUMENTS

| | | | | |
|---|---|---|---|---|
| 332,050 | A | 12/1885 | Carter | |
| 1,366,432 | A * | 1/1921 | Summer | 40/722 |
| 2,092,323 | A | 9/1937 | Myers | |
| 2,649,799 | A * | 8/1953 | Spertus | 40/721 |
| 2,971,277 | A | 2/1961 | Vaillancourt | |
| 3,589,049 | A * | 6/1971 | Cornelius | 40/722 |
| 3,659,355 | A | 5/1972 | Aubin | |
| 4,164,085 | A * | 8/1979 | Steeb et al. | 40/726 |
| 4,828,502 | A | 5/1989 | Leahy | |
| 4,829,686 | A | 5/1989 | Endicott | |
| 5,492,476 | A | 2/1996 | Ball | |
| 5,544,438 | A * | 8/1996 | Fazekas | 40/605 |
| 5,575,094 | A * | 11/1996 | Leake et al. | 40/124.09 |
| 5,833,330 | A | 11/1998 | Kos | |
| 5,845,425 | A * | 12/1998 | Leake et al. | 40/725 |
| 5,924,781 | A | 7/1999 | Mitchell | |
| 5,948,498 | A | 9/1999 | Bianco | |
| 5,987,825 | A | 11/1999 | Rosen | |
| 6,209,248 | B1 * | 4/2001 | Reinhard | 40/768 |
| 6,305,714 | B1 * | 10/2001 | Rossetto et al. | 281/37 |
| 6,364,126 | B1 | 4/2002 | Enriquez | |
| 6,412,744 | B1 | 7/2002 | Wollam | |
| 6,443,415 | B1 | 9/2002 | Sundblad | |
| 6,735,831 | B1 * | 5/2004 | Greiwe et al. | 27/1 |

(Continued)

OTHER PUBLICATIONS

Japanese patent 408317515A to Kenichi Yamada published Nov. 29, 1996, in Japanese with English translation (by machine) from the Japanese Patent Office.

(Continued)

*Primary Examiner*—William L. Miller
(74) *Attorney, Agent, or Firm*—Robert J. Yarbrough

(57) ABSTRACT

The Invention is a message board having a base, a frame and a hinge connecting the frame and base. The frame has an open position and a closed position and defines a frame opening. A planar member releasably retains an artwork within the frame such that the artwork is displayed through the frame opening when the frame is in the closed position. An erasable writing surface is defined by the planar member and is displayed when the frame is in the open position.

17 Claims, 7 Drawing Sheets

U.S. PATENT DOCUMENTS

| | | | | |
|---|---|---|---|---|
| 6,817,124 | B1 | 11/2004 | Ko | |
| 6,854,915 | B1 * | 2/2005 | Ong | 402/3 |
| 7,028,425 | B2 * | 4/2006 | Lasher | 40/781 |
| 2003/0089010 | A1 | 5/2003 | Wechter | |
| 2006/0156605 | A1 * | 7/2006 | Abrams | 40/781 |

OTHER PUBLICATIONS

Japanese patent 410234542A to Mieko Sakai published Sep. 8, 1998, in Japanese with English translation (by machine) from the Japanese Patent Office.

* cited by examiner

MESSAGE BOARD APPARATUS

BACKGROUND OF THE INVENTION

1. Field of the Invention

The Invention relates to message boards and organizers. The Invention relates specifically to a message board that is selectably disguised by an artwork and that may be magnetically attached to a steel surface, such as the surface of a refrigerator.

2. Description of the Prior Art

Message boards have been used for many years to communicate temporary written messages which are subsequently erased or otherwise destroyed. A message board may comprise without limitation a whiteboard, a blackboard or a piece of paper.

As used in this application, the term "whiteboard" means an erasable writing surface suitable for use with conventional 'dry erase' or 'dry wipe' markers. A 'dry erase' or 'dry wipe' marker deposits an ink film on the surface of the whiteboard. The ink film dries to a powder that may be erased from the whiteboard by wiping with a cloth or felt eraser.

Message boards have been developed that disguise all or a part of the message board. For example, U.S. Pat. No. 6,817,124 B1 to Ko issued Nov. 16, 2004 teaches a fabric or web mounted between two rollers to disguise a blackboard or a whiteboard.

Japanese patent number JP410234542A to Mieko Sakai, publication date Sep. 8, 1998, teaches a frame holding a photograph. A hinged panel is attached to the rear of the frame. When in the closed position, the panel is flush with the back of the frame. When in the open position, the panel may display a message. The panel also acts as a prop to support the frame in the upright position, as on a desktop.

U.S. Pat. No. 4,828,502 to Leahy issued May 9, 1989 teaches a whiteboard having two frames. One frame is attached to the wall. The second frame is attached to the first frame by a hinge. The second frame rotates about the hinge to reveal the whiteboard. When closed, the second frame becomes a picture frame displaying a picture and disguising the white board.

U.S. Pat. No. 2,971,277 to Vaillancourt issued Nov. 16, 1959 teaches a wall-mounted blackboard having a slot to receive a panel to disguise the blackboard.

U.S. Pat. No. 2,092,323 to Myers issued Sep. 7, 1937 teaches a blackboard having a movable panel. When the movable panel is attached, a portion of the blackboard is covered.

The prior art does not teach the elements of the present Invention. The prior art does not teach a hinged, framed artwork disguising a message board where the artwork may be placed into or removed from the frame from an inside surface of the frame. The prior art does not teach retaining a whiteboard and the artwork within the message board frame by magnetic attraction. The prior art does not teach a hinged connection between a base and the frame at the lower side of the base to prevent undesirable motion of the frame when a refrigerator door to which the base is attached is opened and closed. The prior art does not teach a magnetic connection between the open frame and the refrigerator door when the frame is in the open position to further reduce undesirable motion.

SUMMARY OF THE INVENTION

The Invention is a message board. Magnets attached to the back side of the message board base allow the base to be magnetically attached to the door of a refrigerator or any other iron or steel surface. A frame is attached to the base by hinges. The frame has a frame interior surface and defines a frame opening. The frame receives an artwork within the frame interior surface and displays the artwork through the frame opening. A planar member is magnetically attracted to the frame and magnetically retains the artwork between the planar member and the interior surface of the frame. The magnetic attraction between the frame and the planar member is created by retaining magnets attached to either the frame or the planar member.

The planar member is substantially flat. A first side of the planar member defines a whiteboard. The second side of the planar member may define another whiteboard, a blackboard, writing paper, or any other surface adapted to bear writing.

As used in this application, the term "artwork" means any substantially flat object selected for its appearance. An "artwork" may be a photograph, painting, printed image or design, decorative fabric or paper or any other substantially two-dimensional object.

The frame has a closed position in which the frame is rotated about the hinges until the frame covers the base and the artwork is display through the frame opening. In the closed position, the message board is disguised as a picture frame, the artwork is displayed and the whiteboard is hidden. The frame also has an open position in which the frame is rotated about the hinges until the whiteboard is exposed for use. In the open position, the white board is displayed and the artwork is hidden.

The hinges are preferably mounted on the lower side of the base so that the frame is hinged downwardly from the base. Hinging the frame from the lower side of the base has the benefit of reduced undesirable movement by the frame when the refrigerator door to which the apparatus is attached is opened or closed. Undesirable movement of the frame also may be reduced by configuring the frame so that the same retaining magnets used to retain the artwork between the frame and the planar member also create a magnetic connection between the frame and the door of the refrigerator when the frame is in the open position.

As an alternative to a magnetic connection, the planar member may be connected to the frame by hook-and-loop fasteners, by mechanical clamps or by any other means known in the art.

The base defines a base internal volume in which pens, pencils, a pad of paper, writing instruments for the whiteboard and an eraser for the whiteboard may be stored. The internal volume of the base also may be used to hold a calendar or to store and organize coupons or other items in pockets or other appropriate receptacles disposed within the base interior volume.

DESCRIPTION OF AN EMBODIMENT

Figure 1:
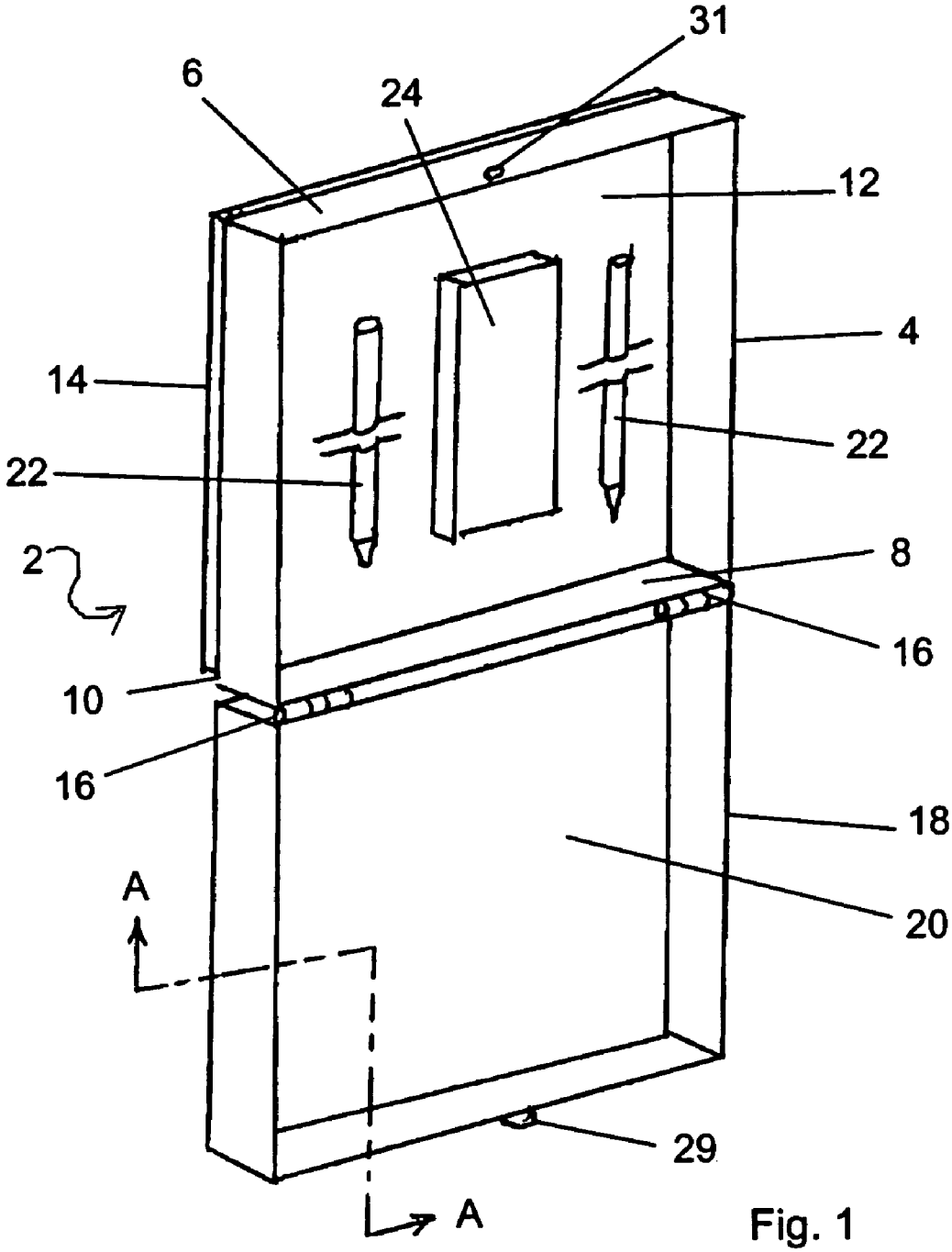
FIG. 1 is a perspective view of the message board of the Invention in an open position displaying a whiteboard.
Figure 2:
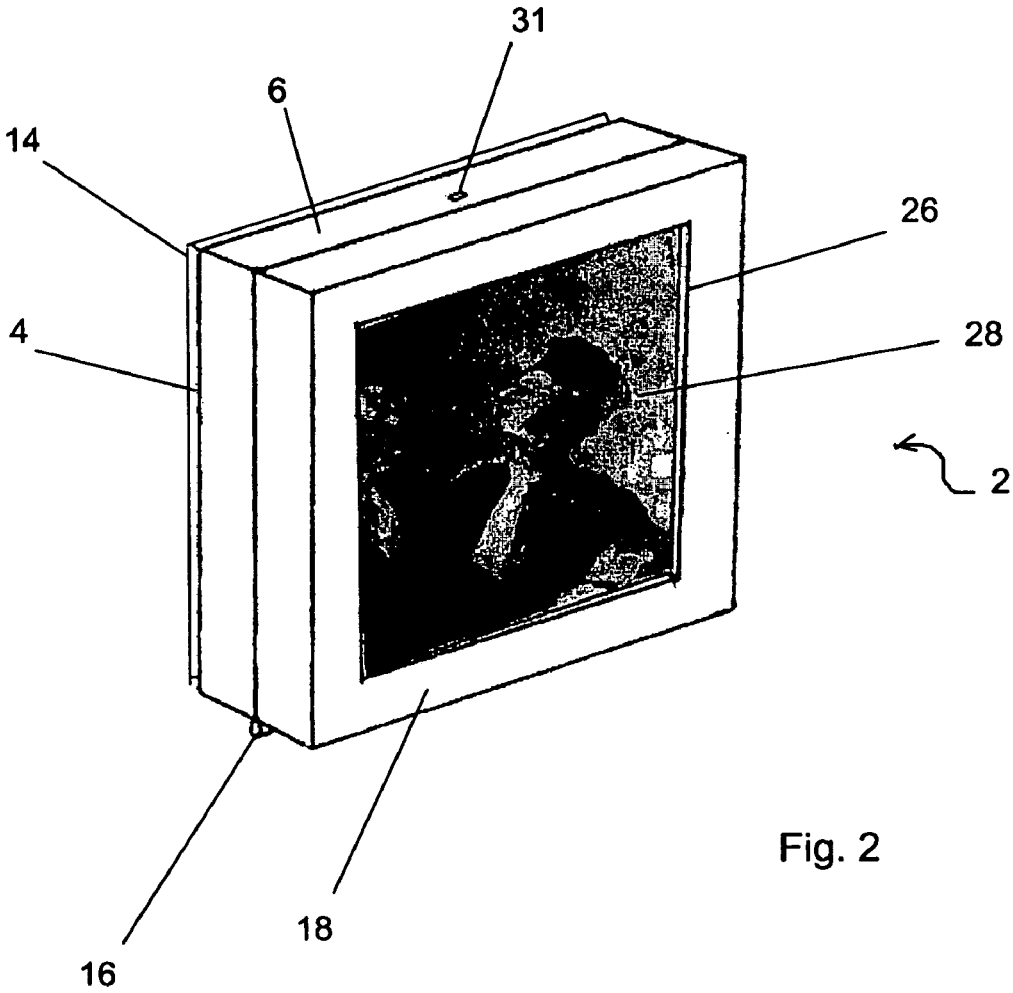
FIG. 2 is a perspective view of the message board of the Invention in a closed position displaying an artwork.

As shown by FIGS. 1 and 2, the message board 2 of the Invention includes a base 4. The base 4 has a upper side 6, a lower side 8 and a back side 10. The base 4 defines a base interior volume 12. A mounting magnet 14 is attached to the back side 10 of the base. The mounting magnet 14 is of adequate magnetic strength to attach the message board 2 to an iron or steel mounting surface, such as the door of a refrigerator, and to support the weight of the message board 2 in a vertical position.

Hinges 16 located on the lower side 8 of the base 4 create a hinged connection between base 4 and a frame 18. The frame 18 depends from the hinges 16 and is able to rotate about the hinged connection between the base 4 and frame 18. The frame 18 has an open position as shown by FIG. 1 and a closed position as shown by FIG. 2.

When the frame 18 is in the open position, an erasable writing surface such as a whiteboard 20 is displayed and is available for use. The base 4 may be configured to retain writing implements 22 and whiteboard 20 accessories within the base interior volume 12. FIG. 1 shows the base interior volume 12 configured to retain a notepad 24 and two writing implements 22, such as pencils, ink pens or dry-erase markers. Other configurations for the base interior volume 12 are available and are contemplated by the Invention. For example, the base interior volume 12 may be configured to display a calendar. The base interior volume 12 also may be configured to retain a whiteboard 20 eraser.

As shown by FIG. 2, the frame 18 defines a frame opening 26. An artwork 28 is displayed through the frame opening 26 when the frame 18 is in the closed position. The message board 2 may be configured so that it appears as a framed artwork 28 when in the closed position, disguising the message board 2.

Figure 3:
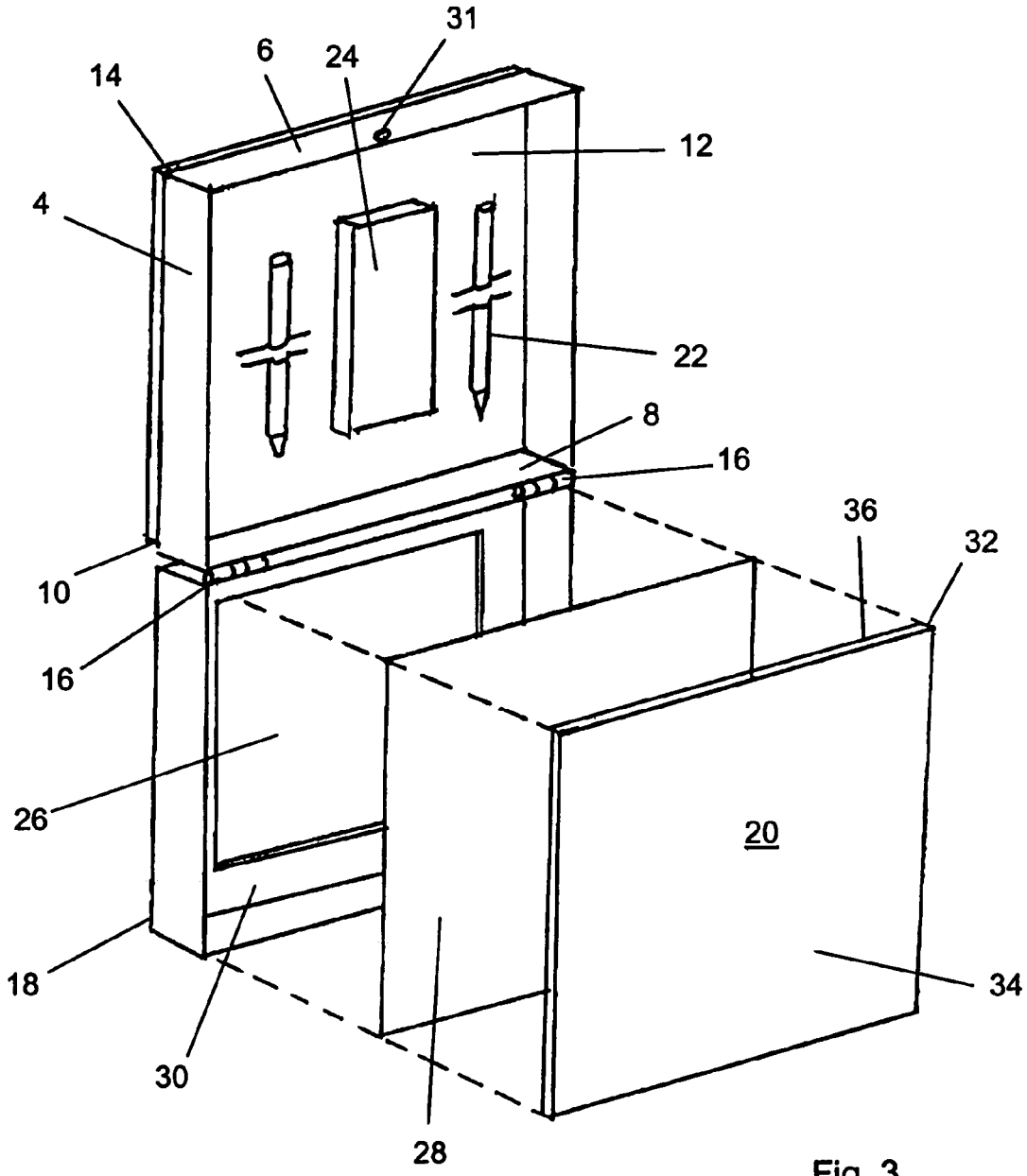
FIG. 3 is an exploded-perspective view showing the relation of the planar member, the artwork and the frame.

In the embodiment illustrated by FIGS. 1 and 2, a spring latch 29 attached to frame 18 engages a corresponding hole 31 in base 4 to selectably retain the frame 18 in the closed position. Any other suitable closure is contemplated by the Invention, including a magnetic closure, FIG. 3 shows an exploded view of the message board 2 in the open position. The frame 18 has an interior frame surface 30 surrounding the frame opening 26. A planar member 32 is magnetically attracted to the frame 18, clamping the artwork 28 between the planar member 32 and the interior frame surface 30. Alternatively, the interior frame surface 30 or the planar member 32 may be relieved to receive the artwork 28, in which case the planar member 32 retains the artwork 28 in the frame 18, but does not clamp the artwork 28 to the interior frame surface 30.

The planar member 32 has a first side 34 and a second side 36. The first side 34 defines a whiteboard 20. The whiteboard 20 may be composed of a suitable polymer, enameled steel, or any other suitable material known in the art. The second side 36 may comprise a second whiteboard, a corkboard, a blackboard, a notepad or any other suitable writing surface. The planar member 32 may be configured so as to be reversible to selectably display the first side 34 or the second side 36 of the planar member 32 when the frame 18 is in the open position.

Figure 4:
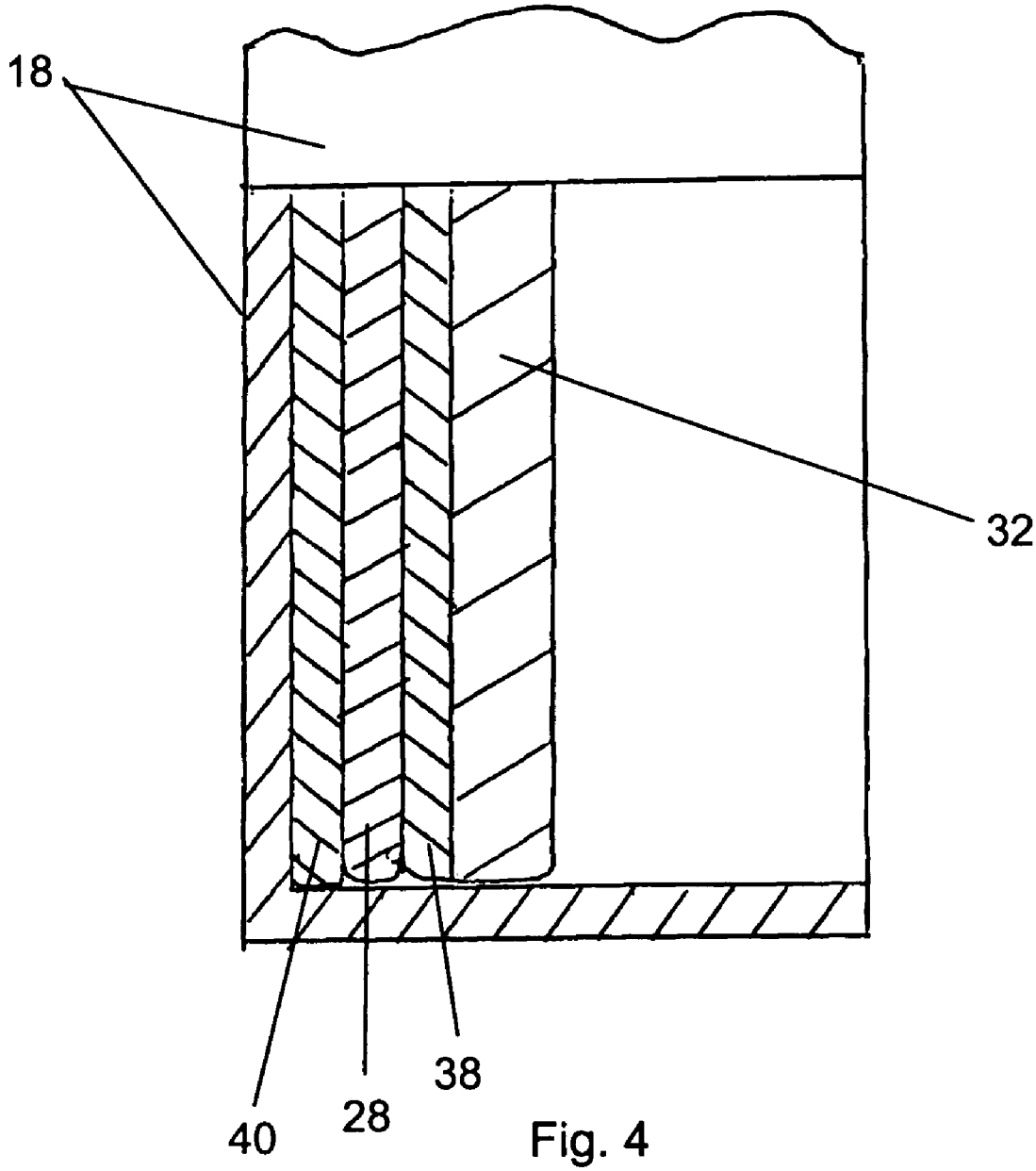
FIG. 4 is a partial detail along section line A-A showing the magnetic attachment of the planar member to the frame.

FIG. 4 is a cross section detail along the section lines A-A of FIG. 1. In the embodiment illustrated by FIG. 4, the planar member 32 has an attached retaining magnet 38 in the form of a magnetic strip. A steel strip 40 is attached to the frame 18 and defines the frame interior surface 30. The retaining magnet 38 is magnetically attracted to the steel strip 40, clamping artwork 28 between the planar member 32 and the frame interior surface 30. Any configuration of magnetic elements suitable to magnetically attract the frame 18 and the planar member 32 is contemplated by the Invention. For example, the retaining magnet 38 may be a cylindrical magnet or a bar magnet imbedded in the planar member 32 or the frame 18.

Figure 5:
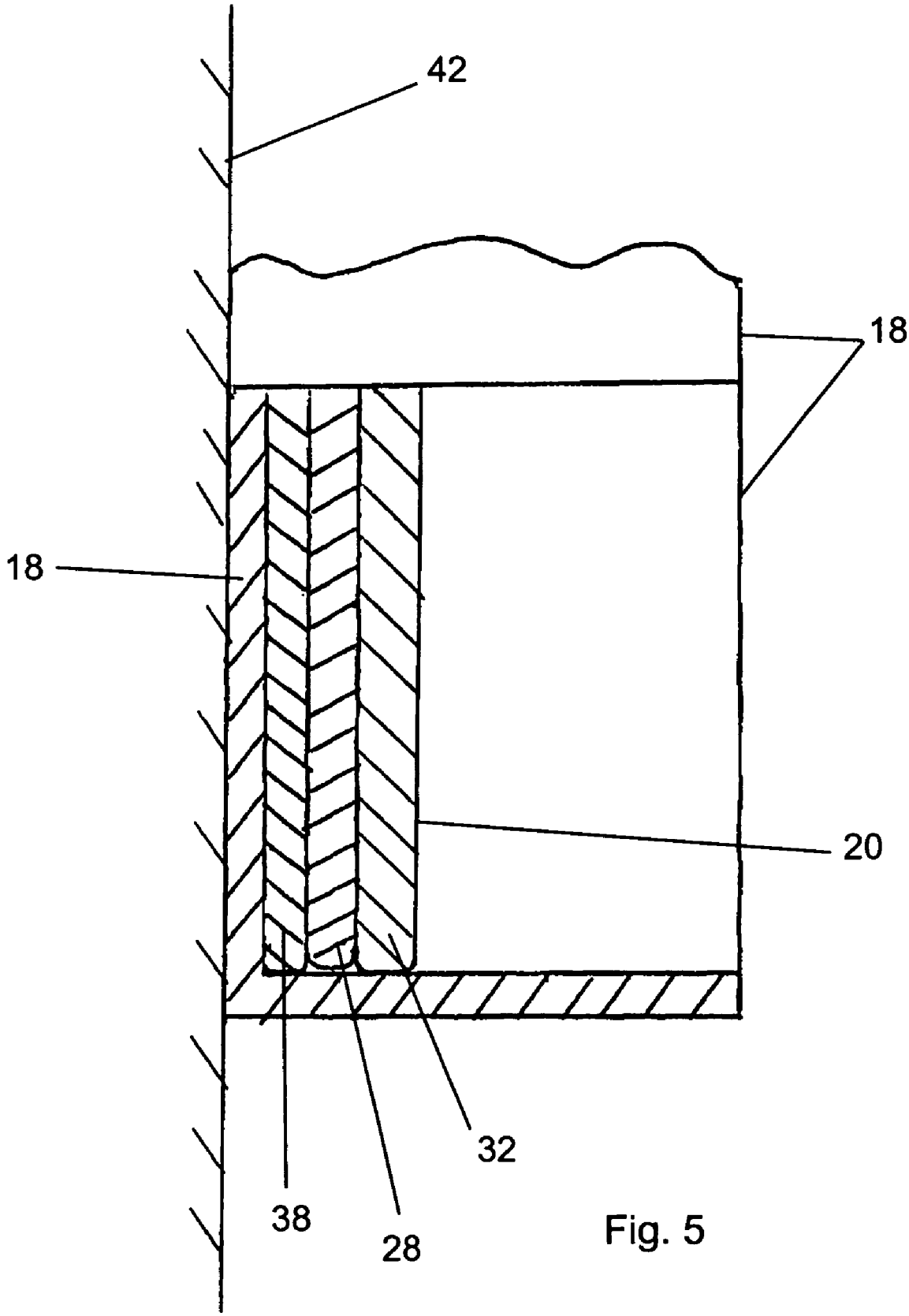
FIG. 5 is a partial detail along section line A-A when the message board is in the open position showing the magnetic attraction between the frame and an iron or steel surface.

FIG. 5 is a cross section detail along the section lines A-A of FIG. 1 of an alternative magnet arrangement. In the alternative of FIG. 5, the retaining magnet 38 is attached to the frame 18 and the planar member 32 is a magnetic material, for example enameled steel. The retaining magnet 38 is magnetically attracted to the steel planar member 32, retaining the artwork 28 in the frame 18.

FIG. 5 also illustrates a feature of the present invention to reduce undesired movement of the frame 18 when the mounting surface 42 moves, as when a refrigerator door is opened or closed. The retaining magnet 38 may magnetically engage the steel of the refrigerator door, urging the frame 18 into contact with the refrigerator door. The force of the magnetic attraction must be overcome for the frame 18 to move, or flap, when the refrigerator door is opened or closed.

The motion of the frame 18 in response to motion of the mounting surface 42 also is controlled by hinging the frame 18 to the lower side 8 of the base 4. The weight of the frame 18, retaining magnet 38 and planar member 32 serve to hold the frame 18 in the open position.

Figure 6:
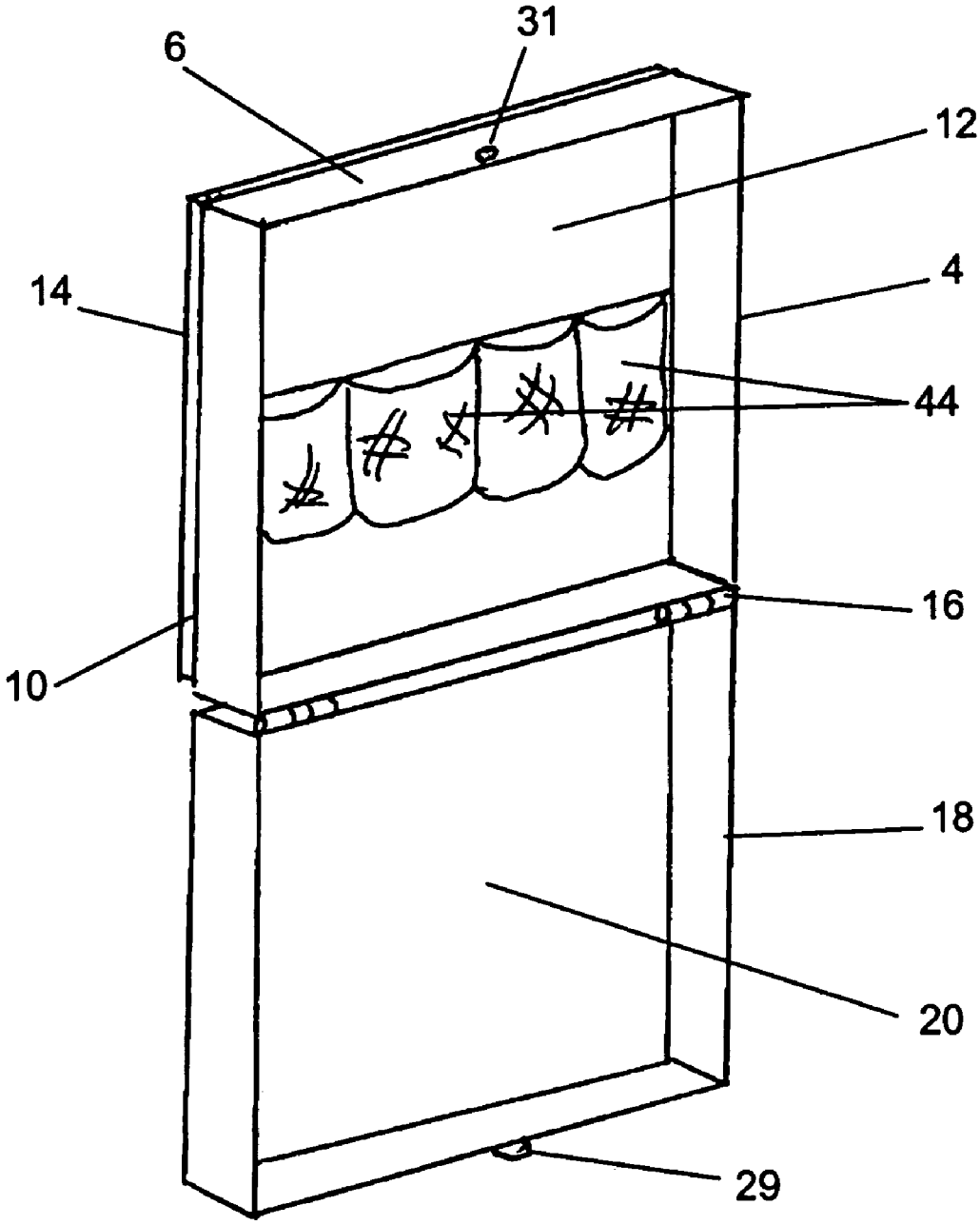
FIG. 6 is an alternative embodiment of the invention including pockets to receive coupons or other papers or objects.

FIG. 6 illustrates an alternative configuration of the base interior volume 12. In the alternative embodiment illustrated by FIG. 6, fabric or net pockets 44 are provided to receive coupons, notes, or other objects.

Figure 7:
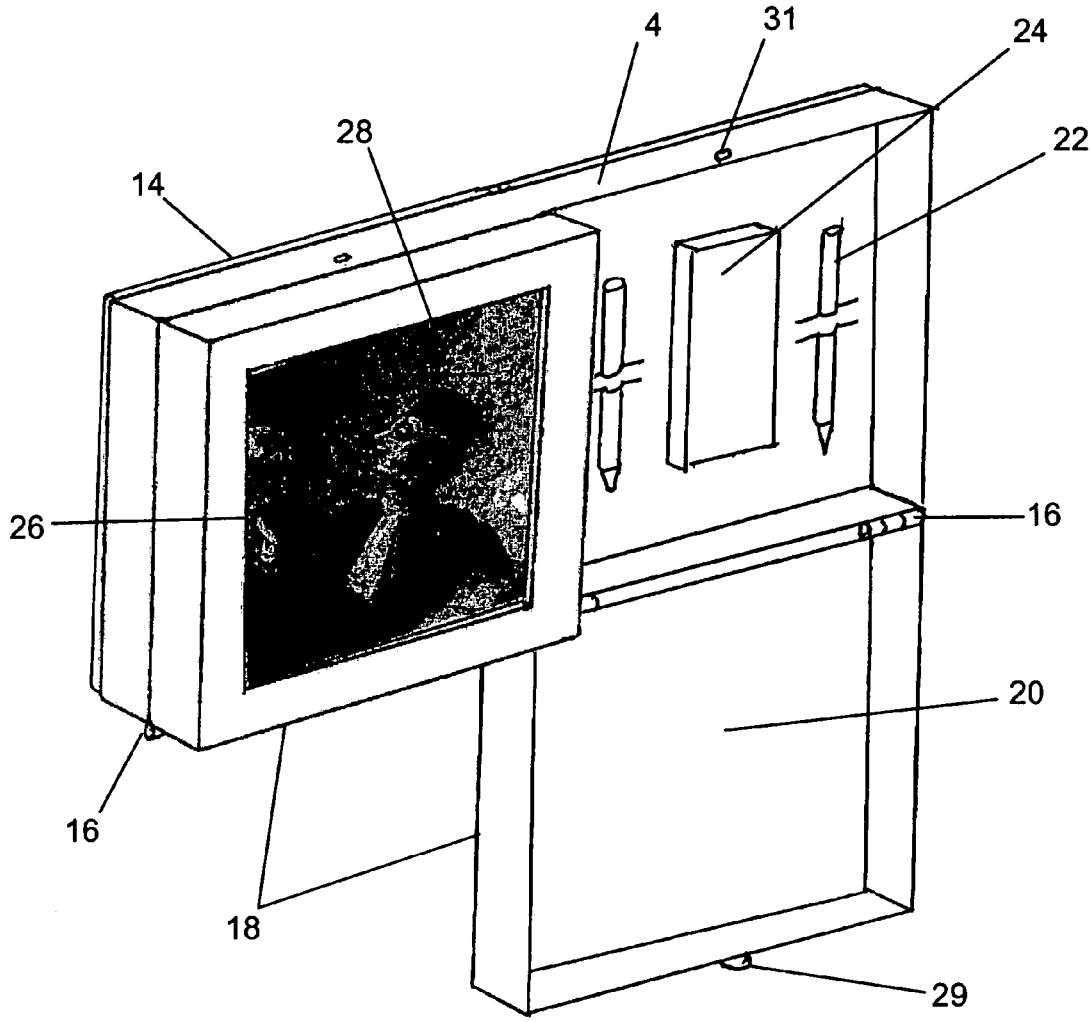
FIG. 7 is an alternative embodiment where multiple message boards are mounted in arrays and share a common base.

FIG. 7 shows that multiple message boards 2 may be mounted together in an array and may share a common base 4. Such a compound message board 2 would be useful, for example, to provide an individual message board 2 for different members of a family.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. A message board apparatus, the apparatus comprising:

a. a base;

b. a frame;

c. a hinge connecting said frame and said base, said frame being rotatable about said hinge, said frame having an open position and a closed position defined by said hinge, said frame having an interior frame surface, said frame defining a frame opening;

d. a planar member, said planar member having a first side and a second side, one of said first and second sides of said planar member and said interior frame surface being in releasable engagement, said planar member being adapted to releasably retain an artwork to said interior frame surface such that said artwork is displayed through said frame opening when said frame is in said closed position;

e. an erasable writing surface defined by said first side of said planar member, wherein said releasable engagement of said planar member to said frame interior surface is a magnetic engagement, and wherein said erasable writing surface is a first whiteboard.

2. The apparatus of claim 1, said magnetic engagement comprising: a retaining magnet attached to one of said planar member and said frame, said retaining magnet magnetically engaging the other of said planar member and said frame.

3. The apparatus of claim 2 wherein said adaptation of said planar member to releasably attach said artwork to said interior surface of said frame comprises: said frame interior surface being configured to receive said artwork and said planar member, said magnetic engagement of said retaining magnet and one of said frame and said planar member selectably clamping said artwork between said frame interior surface and said planar member.

4. The apparatus of claim 3 wherein said second side of said planar member is in said magnetic engagement with said frame and said erasable writing surface is displayed when said frame is in said open position.

5. The apparatus of claim 4 wherein said base defines a base interior volume, said base interior volume being adapted to receive a notepad and a pen or a pencil, said base interior volume being further adapted to receive an erasable surface writing implement and an erasable surface eraser.

6. The apparatus of claim 5, said adaptation of said base interior volume to receive said notepad, said pen or pencil, said erasable surface writing implement and said erasable surface eraser comprising: a plurality of pockets attached to said base and disposed within said base interior volume.

7. The apparatus of claim 3 wherein said first side of said planar member comprises said first whiteboard and wherein said second side of said planar member comprises: one of a cork board, a blackboard, a paper, and a second whiteboard.

8. The apparatus of claim 7 wherein either said first side or said second side of said planar surface is in said magnetic engagement with said frame and the other of said first side and said second side of said planar surface is displayed when said frame is in said open position.

9. The apparatus of claim 3 wherein said base has a back side, the apparatus further comprising: a mounting magnet, said mounting magnet being attached to said back side of said base, said mounting magnet being adapted to magnetically attach said base to a mounting surface.

10. The apparatus of claim 9 wherein said mounting surface is a refrigerator.

11. The apparatus of claim 10 wherein said base has a lower side, said hinge connecting said lower side of said base to said frame.

12. The apparatus of claim 11 wherein said base and said frame are configured so that said retaining magnet magnetically engages said refrigerator when said frame is in said open position, said magnetic engagement between said retaining magnet and said refrigerator urging said frame to maintain contact with said refrigerator.

13. The apparatus of claim 11 wherein said base has an upper side, the apparatus further comprising: a latch, said latch releasably attaching said upper side of said base to said frame when said frame is in said closed position.

14. A message board apparatus, the apparatus comprising:

a. a base having a back side, a lower side and defining an interior volume;

b. a mounting magnet attached to said back side of said base, said mounting magnet being adapted to magnetically attach said base to a refrigerator;

c. a frame having an interior surface, said frame defining a frame opening, said frame being in hinged connection to said lower side of said base, said frame being rotatable about said hinged connection, said frame having a first and a second position defined by said hinged connection;

d. a planar member having a first side and a second side, said frame interior surface being configured to receive one of said first and second sides of said planar member and an artwork, said planar member and said frame being in magnetic engagement, said magnetic engagement of said planar member and said frame selectably clamping said artwork between said planar member and said frame interior surface such that said artwork is visible through said frame opening;

e. a white board writing surface defined by said first side of said planar member, said white board being displayed when said frame is in said open position;

f. a retaining magnet attached to one of said planar member and said frame, said magnetic engagement of said planar member and said frame comprising said retaining magnet.

15. The message board apparatus of claim 14 wherein said retaining magnet magnetically engages said refrigerator when said frame is in said open position, thereby selectably inhibiting motion of said frame.

16. The message board apparatus of claim 15 wherein said base interior volume is adapted to receive a pad of paper, a pen or pencil, a writing instrument for said whiteboard and an eraser for said whiteboard.

17. The message board of claim 15 further comprising: a plurality of pockets attached to said base and disposed within said base interior volume.

* * * * *